US011965313B2

(12) United States Patent
Williams et al.

(10) Patent No.: US 11,965,313 B2
(45) Date of Patent: Apr. 23, 2024

(54) SYSTEM AND METHOD FOR DETERMINING PARALLEL LIFT FEEDFORWARD CONTROL FOR A WHEEL LOADER

(71) Applicant: CNH INDUSTRIAL AMERICA LLC, New Holland, PA (US)

(72) Inventors: Eric John Williams, Fargo, ND (US); Caleb Peterson, Fargo, ND (US); Duqiang Wu, Bolingbrook, IL (US); Joshua D. Zimmerman, Willow Springs, IL (US)

(73) Assignee: CNH Industrial America LLC, New Holland, PA (US)

( * ) Notice: Subject to any disclaimer, the term of this patent is extended or adjusted under 35 U.S.C. 154(b) by 663 days.

(21) Appl. No.: 17/152,951

(22) Filed: Jan. 20, 2021

(65) Prior Publication Data

US 2022/0228349 A1 Jul. 21, 2022

(51) Int. Cl.

| | |
|---|---|
| ***E02F 3/28*** | (2006.01) |
| ***E02F 3/34*** | (2006.01) |
| ***E02F 9/20*** | (2006.01) |

(52) U.S. Cl.

CPC ..... *E02F 9/2079* (2013.01); *E02F 3/3417* (2013.01)

(58) Field of Classification Search

CPC ... E02F 9/2079; E02F 3/04; E02F 3/32; E02F 3/43; E02F 9/20; E02F 3/28; E02F 3/3417; E02F 3/434; G06F 9/20

See application file for complete search history.

(56) References Cited

U.S. PATENT DOCUMENTS 7,310,943 B2 12/2007 Burgart et al.
7,853,384 B2 * 12/2010 Johnson ..... E02F 9/2029 701/91

(Continued)

FOREIGN PATENT DOCUMENTS

DE 102015208015 A1 11/2016
DE 102015225524 A1 6/2017

OTHER PUBLICATIONS

Shigematsu et al., Tip-over prevention control of a teleoperated excavator based on ZMP prediction, 2016, IEEE, p. 1380-1386 (Year: 2016).*

(Continued)

*Primary Examiner* — Marc McDieunel

(74) *Attorney, Agent, or Firm* — Rickard K. DeMille; Rebecca L. Henkel; Peter K. Zacharias

(57) ABSTRACT

A method for determining parallel lift feedforward control of a bucket of a work vehicle is provided. The method includes calculating a current stroke length of a bucket cylinder at a current moment based on a current bell crank plate angle and a current boom angle. The method includes predicting a future boom angle after a certain number of steps. The method further includes calculating a required bell crank plate angle from a learned cutting edge angle and the future boom angle. The method even further includes calculating a future stroke length of the bucket cylinder after the certain number of steps. The method yet further includes calculating an average speed command for bucket control based on the current stroke length and the future stroke length of the bucket cylinder. The method still further includes calculating a bucket cylinder control command based on the average speed command for bucket control.

20 Claims, 5 Drawing Sheets

(56) References Cited

U.S. PATENT DOCUMENTS

| | | | | |
|---|---|---|---|---|
| 8,036,797 | B2 * | 10/2011 | Johnson | E02F 9/2029 701/91 |
| 8,834,317 | B2 | 9/2014 | Wang et al. | |
| 8,874,332 | B2 | 10/2014 | Davis et al. | |
| 8,974,171 | B2 * | 3/2015 | Shirao | E02F 3/432 701/50 |
| 9,435,104 | B2 | 9/2016 | Juricak et al. | |
| 10,407,288 | B2 * | 9/2019 | Hao | E02F 9/02 |
| 11,230,463 | B2 * | 1/2022 | Lombardo | B25J 9/1689 |
| 11,247,885 | B2 * | 2/2022 | Miller | B25J 9/1689 |
| 11,549,236 | B1 * | 1/2023 | Wu | F15B 15/20 |
| 2012/0283746 | A1 * | 11/2012 | Hu | B25J 5/007 901/30 |
| 2016/0205863 | A1 | 7/2016 | Nafziger et al. | |
| 2019/0127194 | A1 * | 5/2019 | Hansen | B66F 11/044 |
| 2021/0010225 | A1 * | 1/2021 | Seki | E02F 9/262 |
| 2022/0403623 | A1 * | 12/2022 | Wu | E02F 9/2041 |
| 2023/0106480 | A1 * | 4/2023 | Wu | E02F 9/2228 701/50 |

OTHER PUBLICATIONS

Tomatsu et al., Model predictive trajectory tracking control for hydraulic excavator on digging operation, 2015, IEEE, p. 1136-1141 (Year: 2015).*

Zhengfu et al., Analysis on dynamic characteristics of closed slewing system for large-scale hydraulic excavator, 2011, IEEE, p. 1-6 (Year: 2011).*

Xu et al., Optimal Design of Hydraulic Excavator Shovel Attachment Based on Multiobjective Evolutionary Algorithm, 2019, IEEE, p. 808-819 (Year: 2019).*

* cited by examiner

SYSTEM AND METHOD FOR DETERMINING PARALLEL LIFT FEEDFORWARD CONTROL FOR A WHEEL LOADER

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates generally to work vehicles and, more particularly, to a system or method for determining a parallel lift feedforward control for an implement (e.g., bucket) coupled to a work vehicle.

A wheel loader is commonly used to load and move substantial volumes of material (e.g., dirt and similar material) from one location to another. A wheel loader includes a relatively large frame and an implement (e.g., bucket) mounted to one end of the frame. The implement may be selectively elevated and selectively tilted to dump materials therefrom. Bi-directional self-level or parallel lift control is difficult via the existing electro-hydraulic control system. In particular, the electro-hydraulic system is kinematically sensitive. In addition, control precision of the existing electro-hydraulic valve is inadequate (e.g., there is no position feedback control for main stage spool of the electro-hydraulic valve). Further, heavy loading results in system delays (e.g., mechanically, hydraulically, and electrically). Even further, the interaction between the boom/bucket movement control and the load sensing system adds complexity.

BRIEF DESCRIPTION

This brief description is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a method for determining parallel lift feedforward control of a bucket of a work vehicle is provided. The method includes calculating, via a controller, a current stroke length of a bucket cylinder at a current moment based on a current bell crank plate angle and a current boom angle. The method also includes predicting, via the controller, a future boom angle after a certain number of steps. The method further includes calculating, via the controller, a required bell crank plate angle from a learned cutting edge angle and the future boom angle. The method even further includes calculating, via the controller, a future stroke length of the bucket cylinder after the certain number of steps. The method yet further includes calculating, via the controller, an average speed command for bucket control based on the current stroke length and the future stroke length of the bucket cylinder. The method still further includes calculating, via the controller, a bucket cylinder control command based on the average speed command for bucket control.

In another embodiment, a processor-based system is provided. The processor-based system includes a non-transitory memory configured to store executable routines. The processor-based system also includes a processing component configured to execute the routines stored in the non-transitory memory, wherein the routines, when executed, cause acts to be performed. The acts include calculating a current stroke length of a bucket cylinder at a current moment based on a current bell crank plate angle and a current boom angle, wherein the bucket cylinder is coupled to a bucket of a work vehicle. The acts also include predicting a future boom angle after a certain number of steps. The acts further include calculating a required bell crank plate angle from a learned cutting edge angle and the future boom angle. The acts even further include calculating a future stroke length of the bucket cylinder after the certain number of steps. The acts yet further include calculating an average speed command for bucket control based on the current stroke length and the future stroke length of the bucket cylinder. The acts still further include calculating a bucket cylinder control command based on the average speed command for bucket control.

In a further embodiment, one or more non-transitory computer-readable media are provided. The computer-readable media encode one or processor-executable routines. The one or more routines, when executed by a processor, cause acts to be performed. The acts include calculating a current stroke length of a bucket cylinder at a current moment based on a current bell crank plate angle and a current boom angle, wherein the bucket cylinder is coupled to a bucket of a work vehicle. The acts also include predicting a future boom angle after a certain number of steps. The acts further include calculating a required bell crank plate angle from a learned cutting edge angle and the future boom angle. The acts even further include calculating a future stroke length of the bucket cylinder after the certain number of steps based on the required bell crank plate angle and the future boom angle. The acts yet further include calculating an average speed command for bucket control based on the current stroke length and the future stroke length of the bucket cylinder. The acts still further include calculating a bucket cylinder control command based on the average speed command for bucket control.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
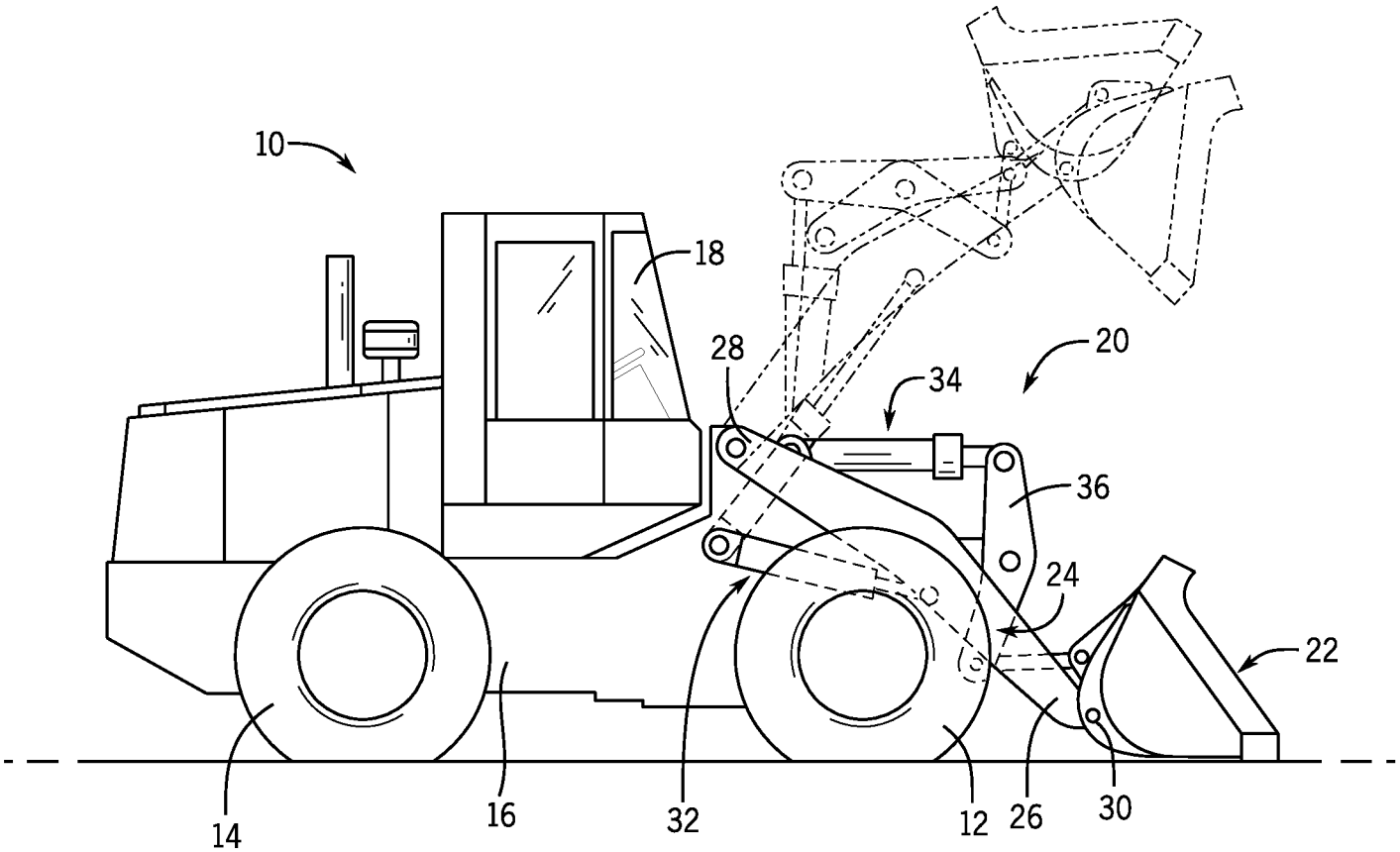
FIG. 1 illustrates a side view of an embodiment of a work vehicle (e.g., wheel loader) equipped with an implement (e.g., bucket), in accordance with aspects of the disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the terms "inner" and "outer"; "up" and "down"; "upper" and "lower"; "upward" and "downward"; "above" and "below"; "inward" and "outward"; "aft" and "forward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members." Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Embodiments of the present disclosure relate generally to determining a parallel lift (PL) or bi-direction self-level (BSL) control for an implement (e.g., bucket) of a work vehicle (e.g., wheel loader). The feed forward command for PL or BSL control enables synchronous control based on boom angle participation. In particular, the feed forward command for PL or BSL control enables synchronous movement of the bucket and a boom of the work vehicle utilizing the electro-hydraulic control system. In particular, a tilt angle of the implement (e.g., bucket) is maintained (e.g., at a constant angle or within a narrow angular range (e.g., ±1 degree)).

FIG. 1 illustrates a side view of an embodiment of a work vehicle 10 (e.g., wheel loader) equipped with an implement 22 (e.g., bucket). As shown, the work vehicle 10 includes a pair of front tires 12, (one of which is shown), a pair of rear tires 14 (one of which is shown) and a frame or chassis 16 coupled to and supported by the tires 12, 14. An operator's cab 18 may be supported by a portion of the chassis 16 and may house various input devices for permitting an operator to control the operation of the work vehicle 10.

Moreover, as shown in FIG. 1, the work vehicle 10 may include a lift assembly 20 for raising and lowering a suitable implement 22 (e.g., a bucket) relative to a driving surface of the vehicle 10. In several embodiments, the lift assembly 20 may include a pair of loader arms 24 (one of which is shown) pivotally coupled between the chassis 16 and the implement 22. For example, as shown in FIG. 1, each loader arm 24 (e.g., boom) may include a forward end 26 and an aft end 28, with the forward end 26 being pivotally coupled to the implement 22 at a forward pivot point 30 and the aft end 28 being pivotally coupled to a portion of the chassis 16.

In addition, the lift assembly 20 may also include a pair of hydraulic lift cylinders 32 (one of which is shown) coupled between the chassis 16 and the loader arms 24 and a hydraulic tilt cylinder 34 coupled between the chassis 16 and the implement 22 (e.g., via a pivotally mounted bell crank plate 36 or other mechanical linkage). It should be readily understood by those of ordinary skill in the art that the lift and tilt cylinders 32, 34 may be utilized to allow the implement 22 to be raised/lowered and/or pivoted relative to the driving surface of the work vehicle 10. For example, the lift cylinders 32 may be extended and retracted in order to pivot the loader arms 24 upward and downwards, respectively, thereby at least partially controlling the vertical positioning of the implement 22 relative to the driving surface. Similarly, the tilt cylinder 34 (e.g., bucket cylinder) may be extended and retracted in order to pivot the implement 22 relative to the loader arms 24 about the forward pivot point 30, thereby controlling the tilt angle or orientation of the implement 22 relative to the driving surface or ground.

As described in greater detail below, the lift assembly 20 is configured to enable BSL or PL control of the implement utilizing electro-hydraulic control to keep the cutting edge at a given tilt angle for all effective tilts (e.g., at positive or negative angles) as the boom (and thus the bucket) changes from a first position to a second position. In particular, a tilt angle of the implement (e.g., bucket) is maintained (e.g., at a constant angle or within a narrow angular range (e.g., ±1 degree)). In certain embodiments, the BSL control or PL control keeps the cutting edge parallel to the driving surface while being raised or lowered. In particular, the techniques described below enable automatically determining a PL or BSL feed forward control command signal for synchronous control (between the boom and the bucket) based on boom angle anticipation.

Figure 2:
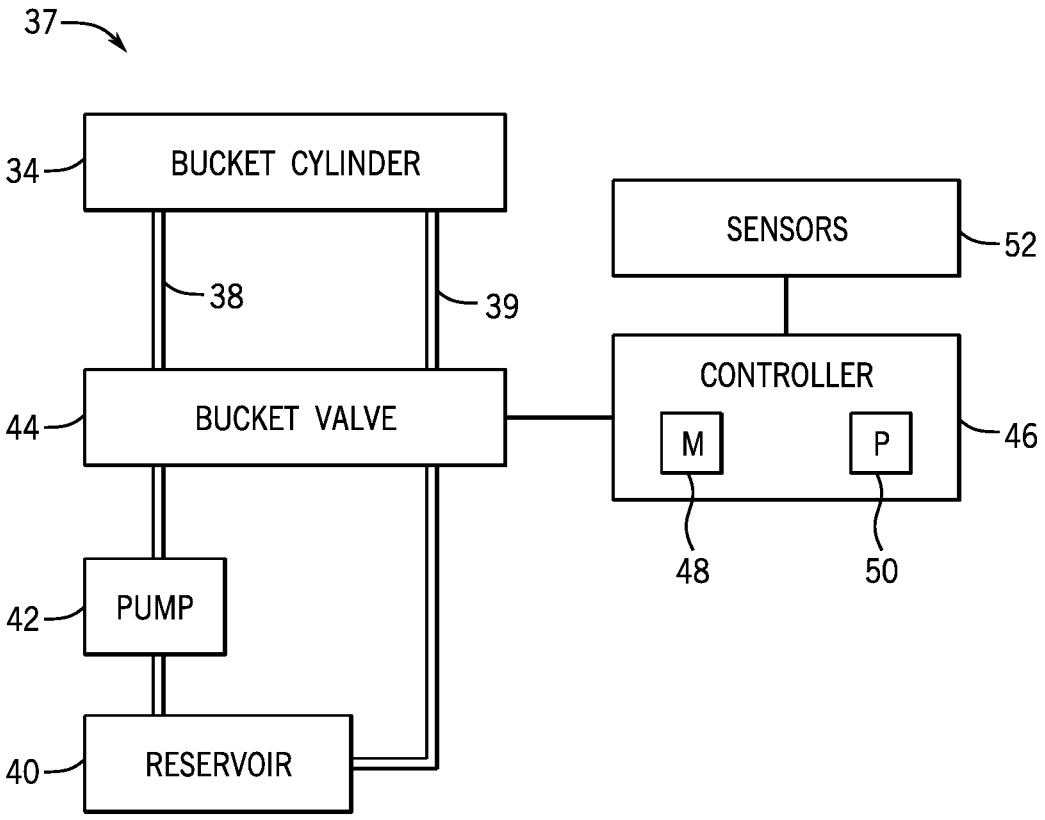
FIG. 2 illustrates a schematic diagram of an embodiment of a control system (e.g., electro-hydraulic control system) coupled to a bucket cylinder, in accordance with aspects of the disclosure.

FIG. 2 is a schematic diagram of an embodiment of a control system 37 (e.g., electro-hydraulic control system) coupled to a bucket cylinder 34 (e.g., tilt cylinder 34 in FIG. 1). It should be noted that other cylinders may be coupled to the control system 37. Fluid flow along conduits 38, 39 controls the operation of the bucket cylinder 34 and, thus, the tilt position of the implement (e.g., bucket) about its horizontal axis. Fluid is provided from a reservoir 40 to the bucket cylinder 34 along the conduit 38 via a pump 42. Fluid is returned to the reservoir 40 via the conduit 39. A control valve (e.g., electro-hydraulic valve) or bucket valve 44 may be disposed along the conduits 38, 39. The control valve 44 is responsive to control signals from a controller 46 that causes the control valve 44 to regulate fluid flow to and from the bucket cylinder 34.

The controller 46 contains computer-readable instructions stored in memory 48 (e.g., non-transitory, tangible, and computer-readable medium/memory circuitry) and a processor 50 which executes the instructions. More specifically, the memory 48 may include volatile memory, such as random access memory (RAM), and/or non-volatile memory, such as read-only memory (ROM), optical drives, hard disc drives, or solid-state drives. Additionally, the processor 50 may include one or more application specific integrated circuits (ASICs), one or more field programmable gate arrays (FPGAs), one or more general purpose processors, or any combination thereof. Furthermore, the term processor is not limited to just those integrated circuits referred to in the art as processors, but broadly refers to computers, processors, microcontrollers, microcomputers, programmable logic controllers, application specific integrated circuits, and other programmable circuits. The processor 50 and memory 48 may be used collectively to support an operating system, software applications and systems, and so forth, useful implementing the techniques described herein. For example, the memory 48 may store instructions for determining a feedforward signal for PL or BSL control of the implement (e.g., bucket). The memory 48 may store a variety of lookup tables. For example, the memory 48 may store a lookup table (e.g., two-dimensional model-based lookup table) relating a joint to joint length or stroke length of the bucket cylinder 34 as a function of a bell crank plate angle ($\beta_{bc}$) and boom angle ($\beta_{boom}$). The memory 48 may also store a lookup table relating a bell crank plate angle to a cutting edge angle. The memory 48 may further store a calibrated bucket valve lookup table. The calibrated bucket valve lookup table relates calibrated bucket valve characteristics. In particular, the calibrated bucket valve lookup table relates a bucket cylinder control command as a function of an average speed command for bucket control. The calibrated bucket valve lookup table is derived at the end of boom valve full open saturation calibration.

The controller 46 may be coupled to a plurality of sensors 52 disposed throughout the lift system 20. For example, the controller 46 may receive feedback regarding boom angle and bell crank plate angle via sensors 52 disposed on the boom (e.g., loader arm 24) and the bell crank plate 36, respectively. In certain embodiments, the sensors 52 may be associated with specific joints. In certain embodiments, the sensors 52 may directly measure cylinder positions. In certain embodiments, the sensors 52 may include inertial measurement unit (IMU) type sensors on the various linkages. In general, any type of sensor for determining kinematic conditions may be utilized.

Figure 3:
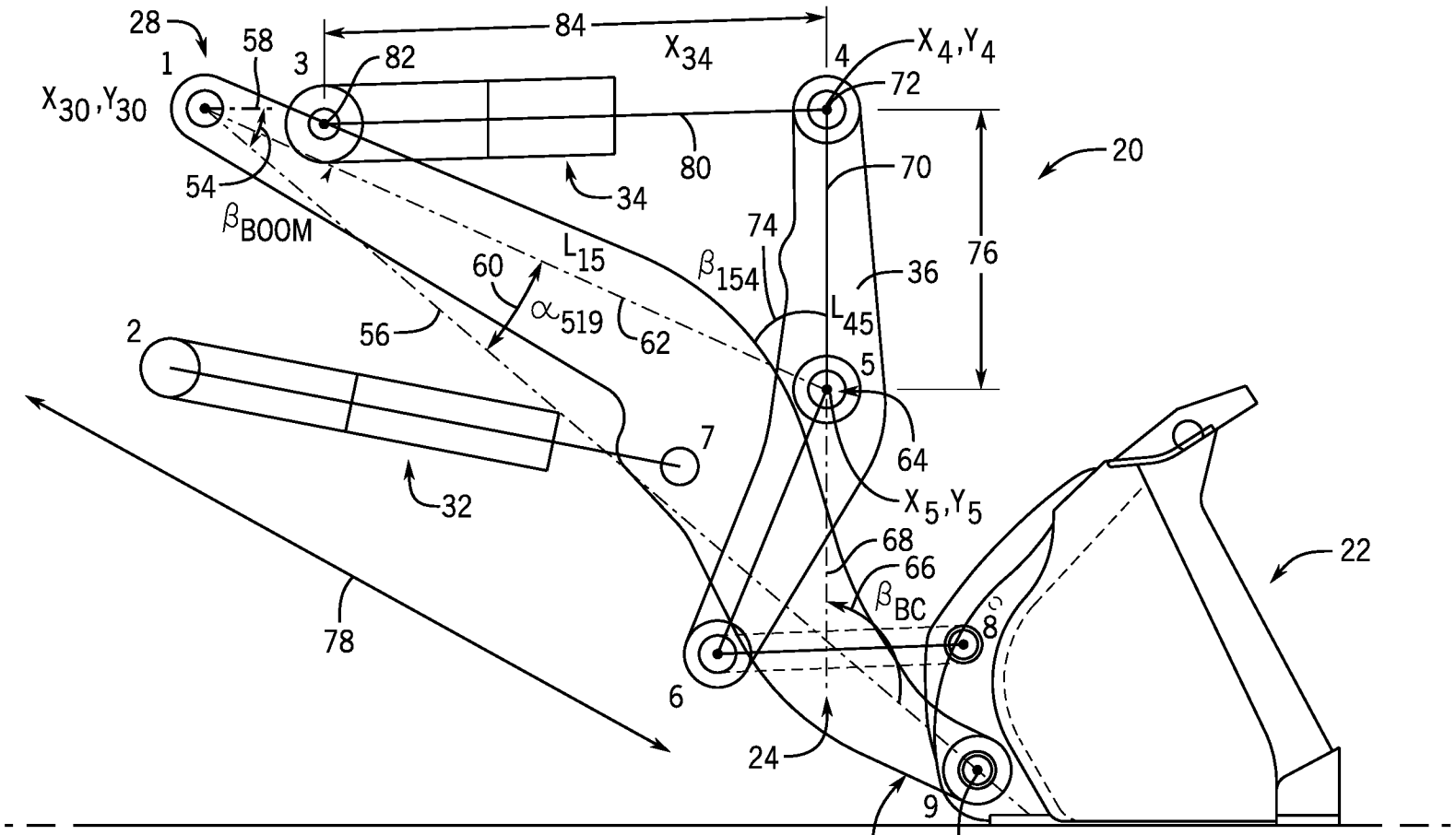
FIG. 3 illustrates a schematic diagram of the lift system in FIG. 1 illustrating various angles and lengths.

To facilitate discussion of the techniques for determining the feedforward command for PL or BSL control of the implement 22 (e.g., bucket), various angles and positions associated with the lift system 20 in FIG. 1 are illustrated in FIG. 3. The components of the lift system 20 are as described in FIG. 1. Angle 54 (the boom angle, $\beta_{boom}$) is formed between a line 56 which connects a boom pin at location 1 (where aft end 28 of the boom 24 is pivotally coupled to the chassis 16, located at coordinate $x_{30}$, $y_{30}$) to bucket pin at location 9 (at the forward pivot point 30) and a horizontal direction or line 58 with the horizontal direction as zero degrees from a side view. The angle 54 is a negative value if lower than the horizontal direction and a positive value if higher than the horizontal direction. Angle 60 ($\alpha_{519}$) is between line 56 and a line 62 connecting the boom pin at location 1 to a bell crank plate rotation joint 64 at location 5 (which is coordinate $x_5$, $y_5$). The angle 60 is a constant angle. Angle 66 ($\beta_{bc}$) is between line 56 and a line 68 extending from the bell crank plate rotation joint 64 at location 5 in a collinear manner with a line 70 extending between location 4 (joint 72 where the bucket cylinder 34 couples to the bell crank plate 36 having coordinate $x_4$, $y_4$) and location 5 (bell crank plate rotation joint 64). Angle 66 extends from a point along line 56, forward of where lines 56, 68 intersect, towards line 68. Angle 74 ($\beta_{154}$) is between line 70 and line 62. Line 70 has a length 76 ($L_{45}$). Line 62 has a length 78 ($L_{15}$). Line 80 extends between a joint 82 at location 3 (where the bucket cylinder 34 is coupled to the loader arm or boom 24) and joint 72 at location 4. Line 80 has a length 84 (e.g., joint to joint length or stroke length, $X_{34}$).

Figure 4:
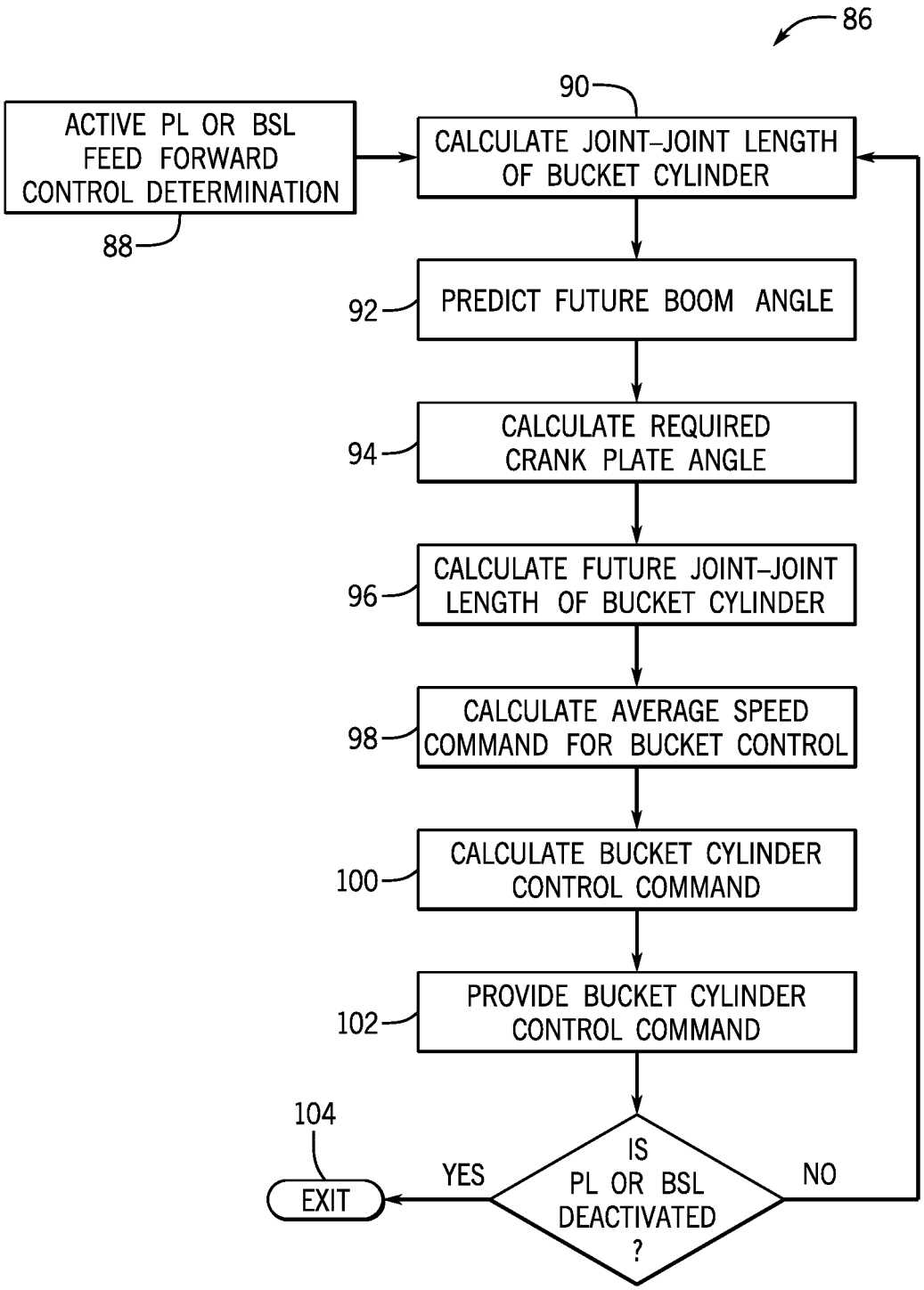
FIG. 4 illustrates a flow chart of a method for determining parallel lift (PL) or bi-direction self-level) control of an implement of a work vehicle, in accordance with aspects of the disclosure.

FIG. 4 illustrates a flow chart of a method 86 for determining PL or BSL control of an implement (e.g., bucket) of a work vehicle (e.g., wheel loader). One or more of the steps may be performed by the electro-hydraulic control system 37 in FIG. 2 (e.g., controller 46). In utilizing the method 86, it is assumed that the bucket control performance is consistent and independent of load condition, temperature variation, runaway load condition, regeneration circuit activation, and flow share condition. The method 86 enables determining PL or BSL's feedforward control contribution more accurately.

The method 86 includes only one tunable factor, N. N is the number of steps. In particular, N represents a boom angle prediction in a predetermined amount of time in the future. The predetermined time period in the future may vary. For example, the predetermined time period may be 5 milliseconds (ms), 10 ms, 15 ms, 20 ms, or another time period. For example, utilizing 10 ms for the time period, if N=1, then this is one step boom angle prediction (10 milliseconds (ms) in the future). If N=20, the boom angle will be predicted at 200 ms in the future. If N is too small, there may be a small signal-to-noise ratio (SNR) which could trigger instability, particularly, when the boom angle is near the vertex point. When a bucket cylinder is locked at a given stroke length, when the boom is lifted from bottom to top, the bucket cutting edge will tilt up and then down. The boom angle at this point where the bucket cutting edge tilts up and then down is the vertex point or vertex angle. When the boom is lowered from top to bottom, the changing tilt direction for the bucket cutting edge is at the same vertex point for the same bucket stroke length. If N is too large, the boom angle prediction may cause a deviation that could result in a large deviation in bucket valve flow control. Thus, starting with a number for N between 5 and 10 and then through tests a reasonable prediction step number N may be determined. In certain embodiments, N may vary depending on a sensitivity and/or noise signal amplitude, e.g., N=k×SNR, where k represents a modulation index.

The method 86 includes activating PL or BSL feed forward control determination (block 88). Activation may occur via an enabling signal from a switch (e.g., enable/disable switch) on a work vehicle (e.g., wheel loader) having the implement (e.g., bucket). In certain embodiments, one or more switches may enable comparing and/or selecting between the method 86 and another control technique.

The method 86 also includes calculating a joint to joint length or stroke length (length 84 ($X_{34}$) in FIG. 3) of a bucket cylinder at a current moment or step based on a current bell crank plate angle ($\beta_{bc}$) and current boom angle ($\beta_{boom}$) (block 90). The current bell crank plate angle and current boom angle come from sensors associated with the lift system as described above. In certain embodiments, the joint to joint length of the bucket cylinder may be determined by utilizing a lookup table (e.g., two-dimensional model-based lookup table) relating a joint to joint length or stroke length of the bucket cylinder 34 as a function of a bell crank plate angle ($\beta_{bc}$) and boom angle ($\beta_{boom}$), where $X_{34}=f(\beta_{bc}, \beta_{boom})$. The lookup table is created offline and stored in memory. The lookup table may vary in size or style. For example, the lookup table may include a matrix of 21×21, which means that every grid is approximately greater than 4 degrees. In another example, if higher precision is desired near the nonlinear region, a 41×41 matrix may be utilized.

In certain embodiments, the joint to joint length of the bucket cylinder may be calculated (e.g., online) in response to a function call utilizing model-based kinematic information. Utilizing the model-based kinematic information includes determining a bell crank plate rotation joint coordinate ($x_5$, $y_5$), where $x_5=L_{15}\cos(\beta_{boom}+\alpha_{519})$ and $y_5=L_{15}\sin(\beta_{boom}+\alpha_{519})$. Utilizing the model-based kinematic information also includes determining the angle, $\beta_{154}$, between $L_{15}$ and $L_{45}$, where $\beta_{154}=\pi-\beta_{bc}+\alpha_{519}$. Utilizing the model-based kinematic information further includes determining the bucket cylinder rod joint's coordinate ($x_4$, $y_4$), where $$x_4 = x_5 + \frac{L_{45}}{L_{15}}(-x_5\cos(\beta_{154}) - y_5\sin(\beta_{154})) \text{ and}$$

$$y_4 = y_5 + \frac{L_{45}}{L_{15}}(x_5\sin(\beta_{154}) - y_5\cos(\beta_{154})).$$

The joint to joint length or stroke length of the bucket cylinder is calculated with the following: $X_{34}=\sqrt{(x_4-x_{30})^2+(y_4-y_{30})^2}$.

Selection between online calculation and lookup table for calculating the joint to joint length of the bucket cylinder may depend on a software's preference in memory size, calculation precision, and calculation reliability. The lookup table would be simple, reliable, and accurate, if more a larger table index number is allowed. However, online calculation takes less memory since only 5 items of the kinematics information are stored (i.e., $L_{45}$, $L_{15}$, $\alpha_{519}$, $x_{30}$, and $y_{30}$).

The method 86 further includes predicting a future boom angle, $\beta_{boomN}$, after a certain number, N, of steps (block 92). The method 86 even further includes calculating a required bell crank plate angle, $\beta_{bcN}$, after N steps from a learned cutting edge angle, $\beta_{cuttingEdgeCMD}$, and the future boom angle, $\beta_{boomN}$ (block 94). In certain embodiments, a lookup table relating a bell crank plate angle to a cutting edge angle may be utilized in calculating the required bell crank plate angle. The method 86 still further includes calculating a future joint to joint or stroke length of the bucket cylinder, $X_{34N}$, after N steps (block 96) based on both the required crank plate angle, $\beta_{bcN}$, and the future boom angle, $\beta_{boomN}$. In certain embodiments, the same lookup table utilized in block 90 may be utilized for block 96. In certain embodiments, in response to a function call, online calculation utilizing model-based kinematic information as described for block 90 may be utilized for block 96.

The method 86 yet further includes calculating an average cylinder speed requirement for the bucket cylinder or average speed command for bucket control of the bucket cylinder (block 98). Calculating the average cylinder speed requirement or average speed command for bucket control is based on the future stroke length and the current stroke length of the bucket cylinder (in particular, the difference between the future stroke length and the current stroke length). In particular, the average cylinder speed requirement or average speed command for bucket control is calculated utilizing the following:

$$BK_{ctrlCMD_mmPs} = \frac{(X_{34N} - X_{34})}{N \times \Delta t},$$

where a sampling interval time is $\Delta t$. The sampling interval time may vary. One example of the sampling interval time is $\Delta t=0.01$ seconds.

The method 86 further includes calculating a bucket cylinder control command based on the average cylinder speed requirement or average speed command for bucket control (block 100). Calculating the bucket cylinder control command may include applying or utilizing a calibrated bucket valve lookup table. The calibrated bucket valve lookup table relates calibrated bucket valve characteristics. In particular, the calibrated bucket valve lookup table relates a bucket cylinder control command as a function of an average speed command for bucket control as shown by $BK_{ctrlCMD_kPa}=f(BK_{ctrlCMD_mmPs})$. The calibrated bucket valve lookup table covers the full valve operation range from valve crack open to flow saturation control.

Figure 5:
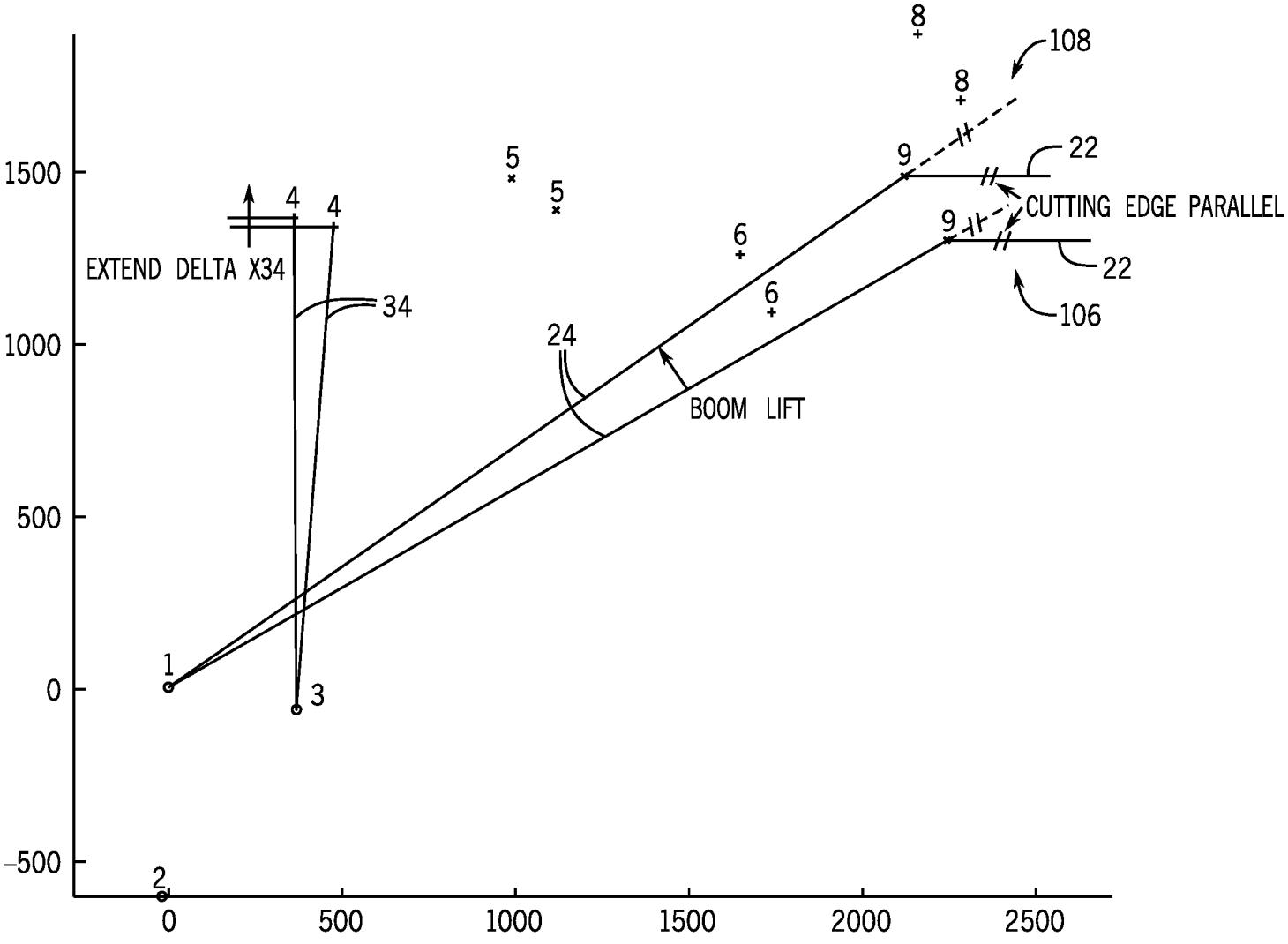
FIG. 5 is a schematic diagram illustrating movement of a bucket cylinder, a boom, and a cutting edge of a bucket during movement.

The method 86 also includes providing the calculated bucket cylinder control command during PL or BSL control to cause synchronous movement of the bucket and the boom of the work vehicle (block 102) to keep the cutting edge at a given tilt angle for all effective tilts (e.g., at positive or negative angles) as the boom (and thus the bucket) changes from a first position to a second position. In particular, a tilt angle of the implement (e.g., the cutting edge of the bucket) is maintained (e.g., at a constant angle or within a narrow angular range (e.g., ±1 degree)). A couple of different tilt angles are illustrated in FIG. 5 for the cutting edge of the implement 22 FIG. 5 illustrates the movement of the bucket cylinder 34, boom 24, and cutting edge of the bucket 22 during movement (e.g., raising or lowering of the bucket 22). Solid line 106 represents the cutting edge at a first angle (with the cutting edge being parallel to a horizontal line or a driving surface of the work vehicle). Dashed line 108 represents the cutting edge at a second angle (e.g., positive tilt angle relative to a horizontal line) different from the first angle. In both examples, the angle of the cutting edge remains constant as the boom 24 is raised or lowered. Returning to FIG. 4, the method 86 further includes determining if PL or BSL control is deactivated (block 104). If PL or BSL control is not deactivated, the method 86 continues (block 90). If PL or BSL control is deactivated, the method 86 has ended (block 104).

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method for determining parallel lift feedforward control of a bucket of a work vehicle, comprising:

calculating, via a controller, a current stroke length of a bucket cylinder at a current moment based on a current bell crank plate angle and a current boom angle;

predicting, via the controller, a future boom angle after a certain number of steps;

calculating, via the controller, a required bell crank plate angle from a learned cutting edge angle and the future boom angle;

calculating, via the controller, a future stroke length of the bucket cylinder after the certain number of steps;

calculating, via the controller, an average speed command for bucket control based on the current stroke length and the future stroke length of the bucket cylinder; and calculating, via the controller, a bucket cylinder control command based on the average speed command for bucket control.

2. The method of claim 1, comprising, via the controller, providing the bucket cylinder control command during parallel lift control to cause synchronous movement of the bucket and a boom of the work vehicle.

3. The method of claim 1, wherein calculating the current stroke length comprises utilizing model-based kinematic information.

4. The method of claim 3, wherein utilizing the model-based kinematic information comprises determining a bell crank plate rotation joint coordinate, determining a bucket cylinder rod joint coordinate, and determining an angle between a first length and a second length, wherein the first length extends from a joint coordinate where a boom is coupled to a frame of the work vehicle to the bell crank plate rotation joint coordinate and the second length extends from the bucket cylinder rod joint coordinate to the bell crank rotation joint coordinate.

5. The method of claim 1, wherein calculating the current stroke length comprises utilizing a lookup table.

6. The method of claim 1, wherein a number of steps is the only tunable parameter.

7. The method of claim 1, wherein calculating the required bell crank plate angle comprises utilizing a lookup table.

8. The method of claim 1, wherein calculating the future stroke length of the bucket cylinder after the certain number of steps is based on the required bell crank plate angle and the future boom angle.

9. The method of claim 1, wherein calculating the average speed command for bucket control comprises determining a difference between the future stroke length and the current stroke length of the bucket cylinder over the certain number of steps multiplied by a sampling interval time.

10. The method of claim 1, wherein calculating the bucket cylinder control command based on the average speed command for bucket control is based on calibrated bucket valve characteristics.

11. A processor-based system, comprising:

a non-transitory memory configured to store executable routines; and a processing component configured to execute the routines stored in the non-transitory memory, wherein the routines, when executed, cause acts to be performed, comprising:

calculating a current stroke length of a bucket cylinder at a current moment based on a current bell crank plate angle and a current boom angle, wherein the bucket cylinder is coupled to a bucket of a work vehicle;

predicting a future boom angle after a certain number of steps;

calculating a required bell crank plate angle from a learned cutting edge angle and the future boom angle;

calculating a future stroke length of the bucket cylinder after the certain number of steps;

calculating an average speed command for bucket control based on the current stroke length and the future stroke length of the bucket cylinder; and calculating a bucket cylinder control command based on the average speed command for bucket control.

12. The processor-based system of claim 11, wherein the routines, when executed, cause acts to be performed further comprising:

providing the bucket cylinder control command during parallel lift control to cause synchronous movement of the bucket and a boom of the work vehicle.

13. The processor-based system of claim 11, wherein calculating the current stroke length comprises utilizing model-based kinematic information.

14. The processor-based system of claim 13, wherein utilizing the model-based kinematic information comprises determining a bell crank plate rotation joint coordinate, determining a bucket cylinder rod joint coordinate, and determining an angle between a first length and a second length, wherein the first length extends from a joint coordinate where a boom is coupled to a frame of the work vehicle to the bell crank plate rotation joint coordinate and the second length extends from the bucket cylinder rod joint coordinate to the bell crank rotation joint coordinate.

15. The processor-based system of claim 11, wherein calculating the current stroke length comprises utilizing a lookup table.

16. The processor-based system of claim 11, wherein a number of steps is the only tunable parameter.

17. The processor-based system of claim 11, wherein calculating the future stroke length of the bucket cylinder after the certain number of steps is based on the required bell crank plate angle and the future boom angle.

18. The processor-based system of claim 11, wherein calculating the average speed command for bucket control comprises determining a difference between the future stroke length and the current stroke length of the bucket cylinder over the certain number of steps multiplied by a sampling interval time.

19. The processor-based system of claim 11, wherein calculating the bucket cylinder control command based on the average speed command for bucket control is based on calibrated bucket valve characteristics.

20. One or more non-transitory computer-readable media encoding one or more processor-executable routines, wherein the one or more routines, when executed by a processor, cause acts to be performed comprising:

calculating a current stroke length of a bucket cylinder at a current moment based on a current bell crank plate angle and a current boom angle, wherein the bucket cylinder is coupled to a bucket of a work vehicle;

predicting a future boom angle after a certain number of steps;

calculating a required bell crank plate angle from a learned cutting edge angle and the future boom angle;

calculating a future stroke length of the bucket cylinder after the certain number of steps based on the required bell crank plate angle and the future boom angle;

calculating an average speed command for bucket control based on the current stroke length and the future stroke length of the bucket cylinder; and calculating a bucket cylinder control command based on the average speed command for bucket control.

* * * * *